United States Patent [19]

Demar

[11] 4,348,968

[45] Sep. 14, 1982

[54] METHOD AND APPARATUS FOR BURNING SOLID FUEL

[76] Inventor: Viking V. Demar, Ave. Conde Sallent 17v, Palma-Mallorca, Spain

[21] Appl. No.: 173,522

[22] Filed: Jul. 30, 1980

[30] Foreign Application Priority Data

Aug. 10, 1979 [GB] United Kingdom ..... 7927988

[51] Int. Cl.[3] ..... F23B 7/00

[52] U.S. Cl. ..... 110/344; 110/101 CD; 110/105; 110/115; 110/249; 110/281; 110/309

[58] Field of Search ..... 110/101 R, 101 A, 101 CB, 110/101 CD, 281, 282, 283, 298, 299, 300, 249, 105, 341, 346, 347, 115, 309

[56] References Cited

U.S. PATENT DOCUMENTS

| | | | |
|---|---|---|---|
| 499,716 | 12/1893 | Coxe . | |
| 527,593 | 10/1894 | Coxe | 110/281 |
| 1,360,285 | 11/1920 | Gibson | 110/101 CB |
| 1,473,633 | 11/1923 | Lea | 110/105 |

FOREIGN PATENT DOCUMENTS

| | | |
|---|---|---|
| 1227764 | of 1971 | United Kingdom . |
| 1446071 | of 1976 | United Kingdom . |

*Primary Examiner*—Edward G. Favors

*Attorney, Agent, or Firm*—Blanchard, Flynn, Thiel, Boutell & Tanis

[57] ABSTRACT

Solid fuel such as coal is fed into an inlet shaft of the furnace through a rotary feeder constructed to prevent the admission of air. Primary air channels supply the major part of the air required for combustion of the fuel in a region in which the fuel bed is sufficiently thick to avoid disturbance and the formation of "holes" by this air. Further, narrower air channels supply sufficient, diffused and low velocity air to complete the combustion of the fuel without substantial entrainment of grit and ash. Air is prevented from flowing in contact with the fuel up stream of the primary channels and the metering edge.

23 Claims, 9 Drawing Figures

METHOD AND APPARATUS FOR BURNING SOLID FUEL

FIELD OF THE INVENTION

This invention relate to a method and apparatus for high intensity and efficient combustion of solid fuel in pieces, for example hard coal.

BACKGROUND OF THE INVENTION

My British Patent Specification Nos. 1,227,764 and 1,446,071 both describe furnaces for burning solid fuel in which the fuel is delivered down an inlet shaft onto a reciprocatory mechanical grate. The grate advances the fuel through an opening into a combustion chamber for the fuel where a stream of air is passed up through the grate and the fuel bed to sustain combustion. The fuel just upstream of its point of entry is heated by the burning fuel and evolves volatile and gaseous components which are drawn, together with some of the air from the air stream, through the fuel at the bottom of the inlet shaft into ducts in the direction opposite to that of movement of the fuel. This mixture of air and volatile and gaseous components is drawn through the duct and passed up through the grate and fuel bed in a hot region of the latter beyond the air stream. While such a furnace is in general very effective in burning coal efficiently at high output, it has been found that it runs the risk of "burning back" (that is: burning of fuel in the inlet shaft) especially at low burning rates (e.g. overnight operation).

Particularly with a view to overcoming this problem the present invention provides a high intensity method of burning solid fuel in pieces comprising the steps of:

advancing the fuel along a path having an upstream portion from which air is excluded, metering the height of the fuel leaving the upstream path portion to define a predetermined cross section for the fuel as it leaves the upstream path portion and enters a downstream path portion in a reverberatory combustion space as a thick fuel bed, passing a first high velocity stream of air from below the path through the fuel bed in a self-sustaining ignition zone, the first stream of air supplying the major portion of the oxygen required for combustion and having upstream and downstream boundaries extending transversely of the path, the fuel being rapidly heated and ignited as it moves through the upstream boundary, the metered height of the fuel bed being such in relation to the speed of advance of the fuel and the distance between the upstream and downstream boundaries that the size of the fuel pieces and the thickness of the burning fuel bed at the downstream boundary is still sufficient to prevent destabilisation of the fuel bed by the first stream, and passing a second, lower velocity stream of air, sufficient to complete combustion, through the fuel bed, the second stream being diffused over a sufficient length of the path downstream of the first stream so as to be of sufficiently low velocity to avoid entrainment of the burning-out fuel particles from the fuel bed.

Correspondingly, the present invention provides a furnace for burning solid fuel in pieces comprising a reverberatory combustion chamber, a mechanical grate for advancing solid fuel along the grate through a metering opening into the combustion chamber, means for supplying solid fuel to fill the entry to the metering opening, means for preventing air from entering the solid fuel upstream of the passage, a first set of air channels through the grate for passing a high-velocity stream of air up through the fuel bed on the grate downstream of the passage entry, the channels defining upstream and downstream boundaries for the first stream and a second set of air channels through the grate for delivering a restricted second stream of diffused air to the portion of the grate downstream of the first channels to complete combustion of the fuel, the arrangement being such that substantially no air from any of the said channels is able to enter the fuel upstream of the metering opening.

If desired, a duct may be included which extends between an inlet in an upper surface of the metering opening and the space beneath the second air channels in the grate for conveying the second air stream, which is here drawn from the first stream together with volatile and gaseous components of the fuel evolved from the fuel as it passes through the opening. With this arrangement, the risk of "burning back" in the fuel inlet is avoided since the second air stream does not enter the fuel upstream of the opening.

BRIEF DESCRIPTION OF THE DRAWINGS

The invention will now be further described by way of example with reference to the accompanying drawings, in which.

DETAILED DESCRIPTION

Figures 1, 2:
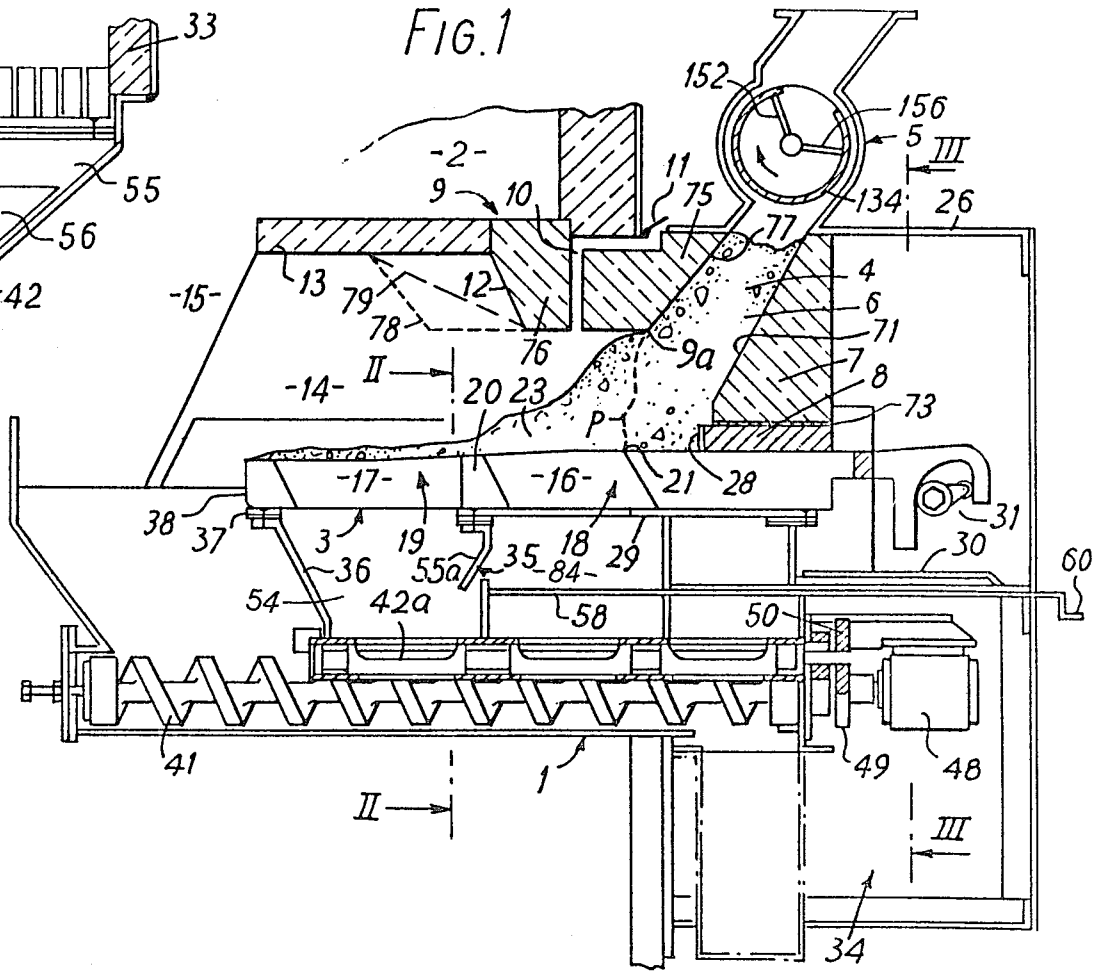
FIG. 1 is a vertical longitudinal section through a furnace in accordance with the invention.
FIG. 2 is part of a cross section on the line II—II of FIG. 1.
Figure 3:
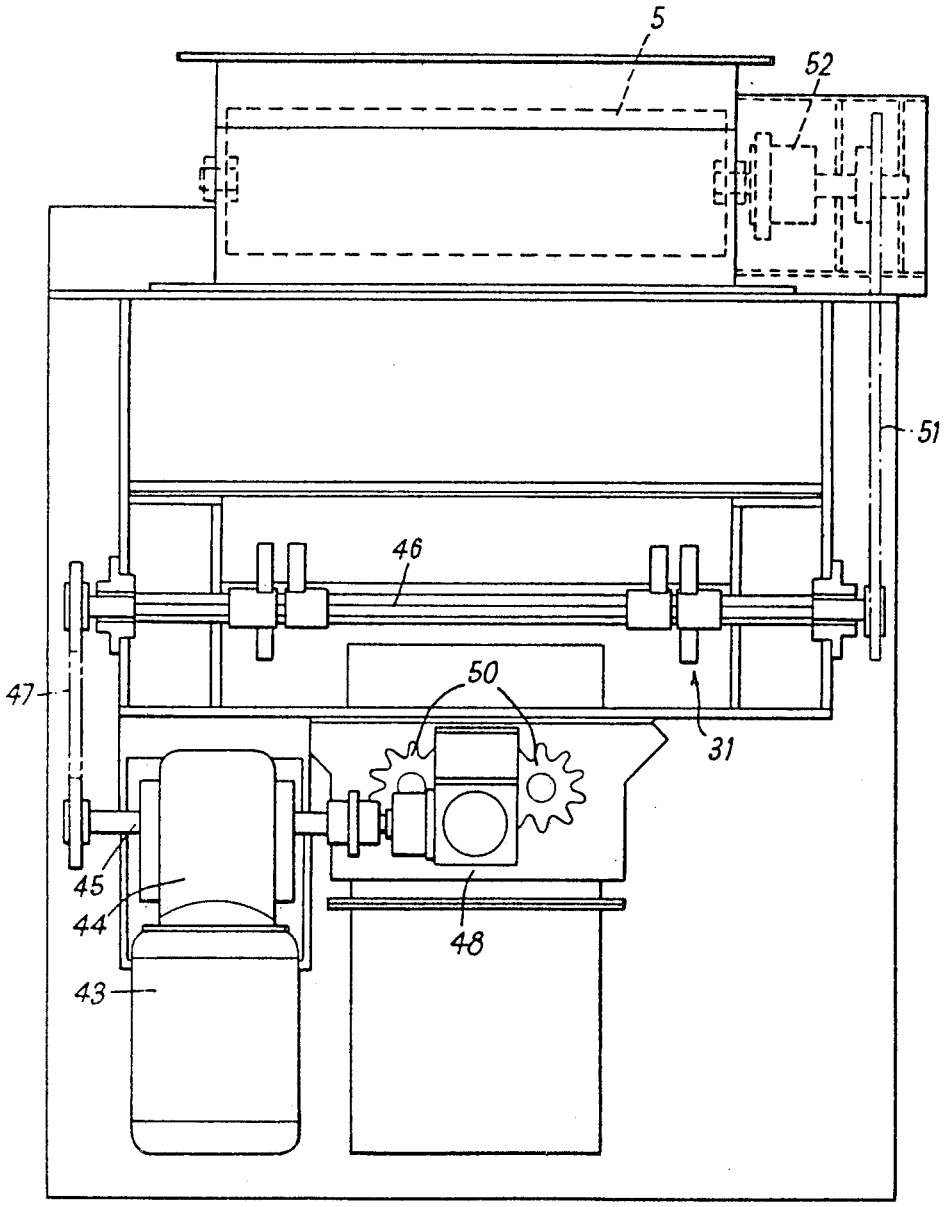
FIG. 3 is a vertical section on the line III—III of FIG. 1.

The furnace shown in FIGS. 1 to 5 has a fabricated framework 1 by means of which it is mounted in an opening in the front wall 2 of a boiler or other device to be heated. The framework 1 forms a support for a reciprocatory grate 3 of the kind shown in British Patent Specification No. 1,229,364. Solid fuel, in the form of coal 4, for example Rank 802 Singles, is delivered onto the front end of the grate 3 from a hopper (not shown) through a rotary feeder 5 (as described in British Patent Specification No. 1,446,071) into an inclined inlet shaft 6, of progressively increasing width, having a chute surface 71 formed on a refractory block 7 supported on a stationary abutment plate 8 immediately above the forward end portions of a set of grate bars which together define the grate 3. The chute surface 71 is inclined to the horizontal at an angle greater than the angle of repose of the coal 4.

A horizontal refractory arch block assembly 9 extends across the full width of the grate just behind the outlet of the inlet shaft 6 and has one or more air passages 10, normally closed by a hinged flap 11. The rear face 12 of the assembly 9 is inclined rearwardly and upwardly at an angle of about 60° to the horizontal to meet the underside of a further horizontal refractory block 13 of high thermal conductivity, the block 13 being preferably of silicon carbide.

The blocks 9 and 13 together with refractory side cheeks 33 form a reverbatory combustion chamber 14 above the grate 3 and, at the rear, this combustion chamber 14 opens into a flue space 15 from which the combustion gases are removed to a flue by an induced draught fan (not shown). The front edge 9*a* of the assembly 9 forms the top edge of a metering opening through which the fuel advances along the grate 3 into the reverbatory combustion chamber 14. Thus the edge 9*a* determines the maximum height of the fuel on the grate, preferably 100 to 150 mm. The metering opening is kept filled by the fuel 4 in the shaft 6.

With the exception of the two laterally outermost grate bars, each of the grate bars has, on each flank, first and second depressions 16 and 17 respectively to define, in conjunction with the respective depressions 16 and 17 of its neighbours, first and second air flow channels 18 and 19 separated from each other by lands or abutments 20 on the flanks of the bars of lengths at least equal to the distance through which each bar moves. With the exceptions of the depressions, the flanks of the grate bars are as close to each other as manufacturing tolerances will permit while allowing free sliding movement between adjacent grate bars.

As can be seen in the drawings, the forward edge of each of the first flow channels 18 is located at a point 21 which is substantially directly below the lowermost and most forward point 9*a* of the inclined surface 77 of the stack 6. Thus, the edge 9*a* and the line of individual points 21 define an upwardly extending boundary zone P separating the green coal 4 from an intense combustion zone in the incandescent fire bed 23 on the region of the grate which includes the channels 18 and 19.

Before it reaches the boundary zone P the green coal is totally protected from the access of air. The rotary feeder 5 is of the kind which, during one complete revolution, can collect a charge of coal from the hopper and deliver the whole of the charge or whatever part of it is required to top up the inner shaft 6, without admitting any substantial quantity of air into the inlet shaft 6. Further, the furnace has a casing indicated generally at 26 which surrounds the portion of the furnace projecting forwardly from the front wall 2 of the boiler and care is taken to provide suitable seals for the various access doors in this casing so as to prevent ingress of air to the forward part of the grate surface.

The underside of the abutment plate 8 is in sliding and sealing contact with the grate bars. The plate 8 has a vertical abutment face 28 in order to engage coal on the bars moving forwards and thus the plate moves the coal relatively along the bars towards the region P.

Air should be prevented from entering upwardly through the inevitable narrow gaps between the forward ends of the grate bars in front of the first channel 18. To achieve this, the forward ends of the grate bars may be slidably supported on a wear plate 29 which extends from one side to the other of the underside of the grate and forwardly from the first channels 18 to a wall 30 beneath the grate operating mechanism 31.

Figure 4:
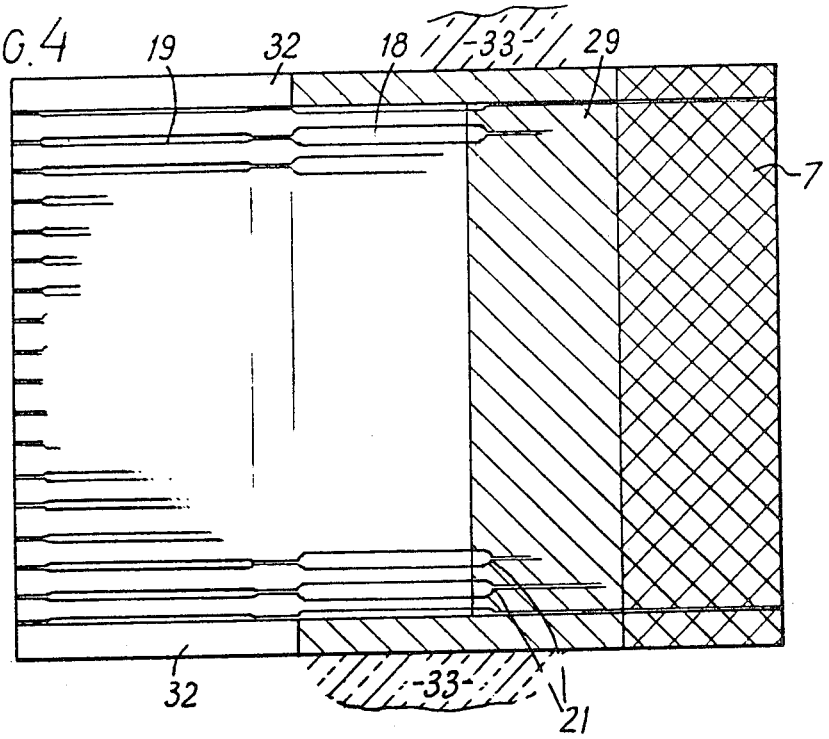
FIG. 4 is a plan view of the grate.

The grate operating mechanism 31 is of the kind described in detail in British Patent Specification No. 1,299,364 in that it advances a first group of grate bars towards the front of the furnace while holding others stationary, then advances the remaining grate bars towards the front and then finally moves all the grate bars together simultaneously to the rear of the furnace to advance the fire bed towards the flue space 15. In this way, the fire bed is kept moving toward the flue space and the risk of formation of clinker is reduced. The top surfaces of the bars over the regions of the first and second air channels 18 and 19 slope slightly downwardly and rearwardly to assist in this operation. Further, as shown in FIG. 4, the wear plate 29 may be extended rearwardly along the two outermost grate bars 32 at least as far as the rear ends of the depressions 16 of the other grate bars. In this way, the access of air to fuel adjacent the refractory side cheeks 33 is reduced, thereby reducing the temperature and the chance of clinker building up on the side cheeks 33. It may be found desirable to mount scraper pegs, for example four spaced upwardly extending metal bars, on the upper surface of each of the two outermost bars 32 to assist in preventing clinker formation on the side cheeks 33.

Primary air for combustion of the coal is supplied along the underside of the wear plate 29 from an inlet 34 at the front of the furnace into a primary distribution chamber 84 located below the first channels 17. Beneath the grate 3 are two transverse partitions 35 and 36. The rear partition 36 carries a wear plate 37 which slidably supports the rear ends 38 of the grate bars and forms effectively a seal with them.

Figure 5:
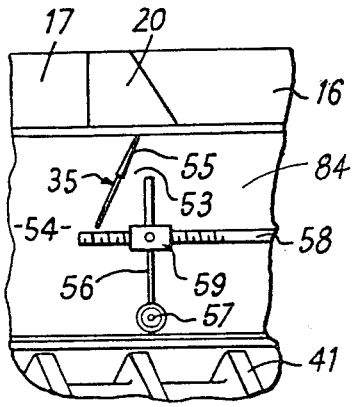
FIG. 5 shows a detail of FIG. 1 on an enlarged scale.

FIG. 5 shows the partition 35 on an enlarged scale. To ensure that the air passing upwards through the second channels 19 is distributed along the length of these channels and thus to avoid this flow being concentrated adjacent the abutments 20, the partition 35 has an opening 53 which is spaced below the grate and is angled to direct the air from chamber 84 into the secondary distribution chamber 54 below the grate with a downward component of direction.

For this purpose, the partition comprises a fixed upper wall component 55 having its upper edge adjacent the underside of the grate bars and their abutments 20 and having at least its lower part sloping downwardly and rearwardly to form a louvre or shield to prevent riddlings and ash from entering the opening 53.

The lower part of the partition 35 is formed by a plate 56 which is substantially upright but is preferably hinged or slightly flexible at its lower edge 57 to enable the size of the opening 53 to be adjusted by means of a screw-threaded rod 58 engaged in a bush 59 carried by the plate 56 and extending to an adjustment knob or handle 60 at the front of the furnace casing.

The plate 56 is adjusted into a position to pass a restricted proportion, between 5% and 15%, say 8%, as measured during cold tests, of the total air entering the inlet 34 to pass into the chamber 54 and then upwardly through the second air channels 19.

Ash and riddlings falling from the grate through the channels 18 and 19 and from the rear end of the grate collect in closed spaces in the bottom of the furnace and may be periodically removed. In the illustrated furnace, the ashes and riddlings are however removed by means of an ash screw 41 and a pair of ash-removing cylinder 42 (which are formed with pockets 42*a* to convey ash and riddlings to the screw 41 without allowing additional air to enter the space beneath the grate), this arrangement being the kind described in British patent Specification No. 1,446,071.

The various moving parts of the furnace are driven by an electric motor 43 (FIG. 3) which drives into a reduction gearbox 44 having an output shaft 45 one end of which drives the camshaft 46 of the grate mechanism 31 through a chain and sprocket drive 47 while the other end of the shaft 45 drives the ash screw 41 (when included) through a bevel gearbox 48. The ash screw 41 in turn drives the ash-removing cylinders 42 through spur gears 49 and 50 while the camshaft 46 drives the rotary feeder 5 through a further chain and sprocket drive 51 and a manually disengageable dog clutch 52.

In operation, with the coal hopper supplied with coal, and sealed against the entry of air, the motor 43 is started up and the rotary feed member 5 delivers coal down the shaft 6 until a body of coal is built up on the grate and fills the shaft 6. The coal on the grate in the region of the first air channels 18 can then be ignited for example by means of a gas burner (not shown). Under the action of the induced draught fan, the coal on the grate is rapidly kindled and forms the fire bed 23. The fire cannot spread forwards of the boundary zone P since no air can enter the coal in front of the boundary zone. By adjusting the output of the induced draught fan and the speed of the motor 43, the desired rate of heat production may be obtained. As much as 360 kg of coal per square meter of grate surface may be burnt in one hour at low primary air level and without visible emission of smoke.

If it is desired to damp down the fire rapidly, this may be achieved by opening the cover 11 and switching off the motor 43.

In order to obtain rapid smokeless combustion, it is important to ensure that the proper proportion of air enters through the first channels 18. For this purpose, they are made laterally wider than the second channels 19, being in this embodiment 9 mm. wide while the second air channels 19 are 3 mm. wide, the length of the first and second channels, as measured along the length direction of the grate bars being respectively 185 mm. and 245 mm. while the width of the grate is 585 mm.

The width of the first and second air channels should be sufficiently narrow to prevent partially burning fuel from falling through the channels. In general, the furnace achieves effectively smokeless combustion of coal at high intensity with low excess primary air and without the addition of secondary air to dilute the flue gases. The portion of the fire bed 23 through which the first, high velocity air stream passes consists mainly of larger pieces of burning fuel and is of sufficient depth throughout this portion to prevent destabilisation and the formation of holes in the fire bed. This is achieved by appropriate choice of the length of the first channels 18 in relation to the height of the metering opening and the speed of the grate and avoids grit and partially burnt fuel being entrained in the first air stream.

Over the remainder of the fire bed, the burning fuel pieces will be smaller and more readily entrained in a high velocity air stream. The plate 56 is adjusted so that the opening 53 delivers not much more air than is required to complete combustion. This air enters the chamber 54 below the second channels 19 with a downward component of motion and in a region spaced below the grate. This air is accordingly diffused over the length of the channels 19. This length is accordingly chosen so that the velocity of the air required to complete combustion is sufficiently low not to entrain grit and incompletely burnt fuel.

Figure 6:
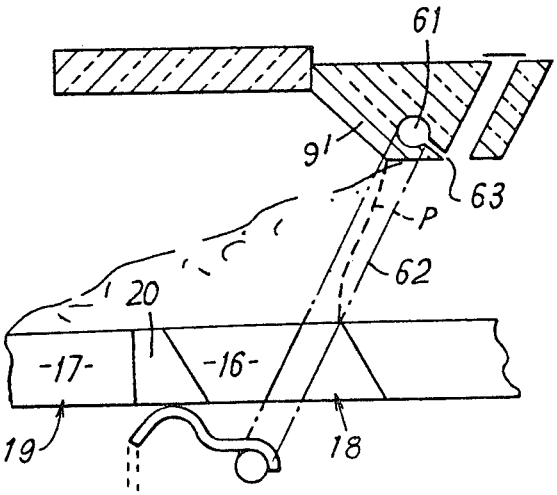
FIG. 6 similarly shows another detail of FIG. 1 incorporating a further modification.

In the modified embodiment illustrated in FIG. 6, the partition 35 has the form shown in FIG. 1 of Patent Specification No. 1,446,071, but extends fully up to the underside of the grate. The enclosed space beneath the second air channels 19 is connected by two side ducts 62 of constant cross-section to inlets 63 adjacent the zone P preferably in the arch block 9 just upstream of the ignition zone P as shown for example in FIG. 6. These ducts 62 draw gaseous and volatile components evolved by the coal adjacent the zone P, together with some air into the said space and thence through the second channels 19 into the hot fire bed where the gaseous and volatile components are intensely heated and burnt.

In the construction shown in FIG. 6, the arch block 9' is moulded with an internal duct 61, the two ends of which open the said side ducts 62. An entry slot 63 leading into the internal duct 61 has a width of about 5 mm. and extends over the width of the grate with the possible exception of the two side portions of the grate.

As can be seen in FIG. 1 the lower wall 71 of the fuel inlet shaft slopes continuously and uniformly from the rotary feeder 5 down to the top surface of the grate 3. The lower portion of the wall 71, formed by the refractory block 7 which can be of low thermal conductivity, and the bottom of the block is protected by a sheet metal plate 73 against accidental damage. While the plate 73 may itself rest on top of the grate 3 and have a vertical abutment flange, it may be found preferable to interpose the removable abutment block 8 of refractory or metal, as shown in the drawing. Removal of the block 8 provides access for a cleaning rod or other tools should this be required at any time, for example for the removal of deposits or clinker from the grate or refractories. Since in operation, no relative movement occurs between the block 8 and the refractory block 7, there is no need to provide a running clearance between them and there can therefore be made a close fit, thereby helping to prevent air passing between them.

The arch block assembly 9 under which the fuel passes along the grate 3 is formed by two refractory arch blocks 75 and 76 (FIG. 1) which between them define the air passages 10 through which air can be introduced to "kill" the fire. The coal supporting face 71 slopes at a greater angle to the horizontal than the inclined face 77 of the block 75 so that the cross-sectional area of fuel inlet shaft 6 increases progressively from the rotary feeder 5 downwards, thereby avoiding any tendency of coal to stick or jam if it should swell as a result of being heated. Again, the cross-sectional area of the passage formed between the underside of the arch block 75 and the top surface of the grate 3 is greater than the cross-sectional area of the lower end of the fuel inlet shaft so that again there is little chance of coal sticking.

If desired, the arch block 76 may be extended into the combustion chamber 14 as indicated at 78 or 79 although it may be found that this extended part of the arch block 76 may become over-heated.

While the block 8 could be secured to say the two outermost grate bars to act as a mechanical pusher should some further mechanical means be found necessary for moving the fuel into the passage beneath the arch, it is preferred that the pusher should be in the form of a transverse wall 152 in the drum 134 of the feeder 5. The operation of such a pusher will be described below with reference to FIGS. 8 and 9. The quantity of fuel delivered by the feeder during each revolution of the drum (and each pushing operation by the wall 152) may be preset by installing a second wall 156 in the drum, thereby determining the volume of the coal-receiving pocket formed in the drum.

It will be noted in FIG. 1 that the wall 71 forms an obtuse angle with the top surface of the grate and avoids any significant dead space in which coal could collect and remain stationery.

Figure 7:
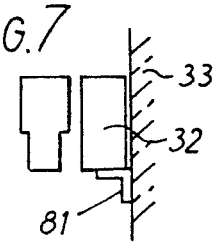
FIG. 7 shows a detail of FIG. 2 on an enlarged scale and, FIGS. 8 and 9 show on an enlarged scale the feeder of FIG. 1 in successive operating positions.

FIG. 7 shows an arrangement which may be used to prevent air passing upwards between the outermost grate bars 52 and the side cheeks 33 of the furnace, with a view to preventing high temperatures and the formation of clinker on the side walls. With this arrangement, a length of angle-iron 81 is fixed to the side walls 33 in contact with the under side of the adjacent grate bar 32.

The rotary metering coal feeder 5 and its operation will now be described in greater detail with reference to FIGS. 8 and 9.

The feeder cylinder 110 consists of a cylindrical wall and is closed at both ends by end walls provided with trunnions for rotatably journalling the cylinder and driving the cylinder in the direction indicated by arrow 112 by means of the driving mechanism 51, 52.

The cylinder has a longitudinal opening 114 extending between the end walls, said opening having a predetermined width between its leading edge 116 and its rear edge 118, seen in the direction of rotation.

The cylinder is rotatable in a housing having two opposite substantially cylindrical walls 120,127 which are positioned close to the cylinder to provide sealing.

On top of the housing is an opening 126 connected to the upper portion 128 of the chute for receiving coal from the hopper or other coal supply, not shown. The upper opening of the housing has a rear edge 130 and a front edge 132.

In the bottom of the housing is an opening 134 having a front edge 135 and a rear edge 137.

The front wall 146 of the lower chute portion is a plate which at its upper end merges via an intermediate portion 148 into the front wall 127 of the housing. The front wall 146 of the chute is inclined to the horizontal at an angle greater than the angle of repose of the coal shown and including an access door 159 hinged at 160. The rear wall of the chute has about the same inclination as the front wall 146 and is composed of a plate 149 and the end surface 77 of the refractory arch block 9 or 75.

Within the cylinder is the substantially radial partition 152 which extends along the whole length of the cylinder and has its radially outer edge secured to the inside of the cylinder wall in the area of the sharp rear cutting edge 118 of the cylinder opening. The radially inner edge of the partition wall is located near the axis 154 of the cylinder and is there connected to an extra or second partition wall 156 which also is substantially radial in the example shown and is arranged substantially at right angles to the first partition wall 152.

Figure 8:
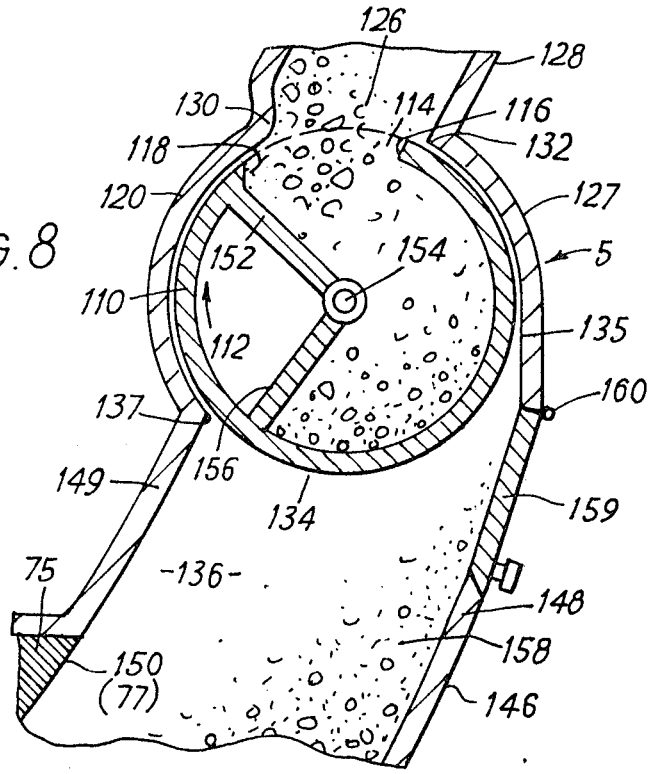

The rotary feeder operates as follows:

In FIG. 8 the cylinder opening 114 faces upwards and coal pieces have filled the space between the walls 152, 156. The level of coal in the lower chute portion 136 has sunk because coal has been fed out onto the grate 3 to form the fire bed.

The coal layer 158 adjacent the inclined wall 146 forms a kind of inclined column having a tendency to become stationary which to a certain degree may reduce the flow of coal through the chute portions 136. Further, the coal pieces in the chute are subjected to heat radiation from the combustion chamber and its walls, particularly from the heated refractory arch block 9 or 75, and this heating results in swelling of the coal and risk of creating bridges of swelling coal pieces pressing against each other between the wall 146 and the walls 149, 150 and thus obstructing the passage of coal in the chute.

Figure 9:
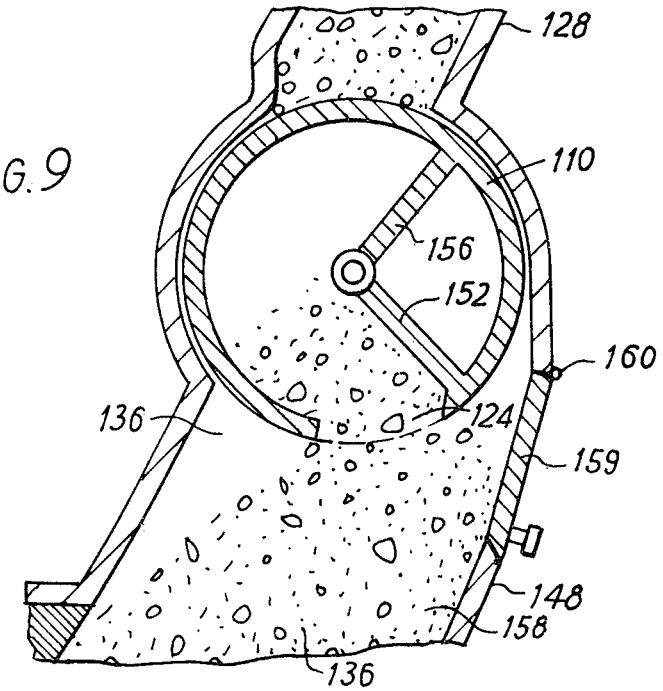

When the cylinder 110 has been rotated to the position in FIG. 9, the opening 114 is completely covered by the cylindrical housing wall 124 and so that the connection between lower chute portions 136 and the upper chute portion 128 is still practically completely closed in order to prevent air being admitted down into the lower chute portion and to eliminate the risk that fire may spread backwards from the grate and up through the chute to the coal supply.

During movement from the position in FIG. 8 to the position in FIG. 9 the wall 152 has all the time pushed the coal pieces in the cylinder to follow the rotation of the cylinder. In reaching the position shown in FIG. 9, the pressure from the wall 152 in the direction of rotation has been transferred to the layer 158 when the coal pieces falling from the cylinder into the lower chute portion have built the layer 158 to a height where the upper end of the layer is adjacent the cylinder. Accordingly, the rotation of the cylinder has caused the wall 152 to transmit pressure through the coal pieces in the cylinder onto the layer 158 which is thus pressed and moved downwardly. Further, the rest of the coal in the lower chute portion will be influenced by this pressure from the partition wall 152 to maintain the flow of all coal in the lower chute portion 136. Accordingly, formation of flow obstructing bridges of swelling coal pieces is prevented.

On further rotation, the cylinder opening is sealingly covered by the cylindrical housing wall 120 so that both air and fire are prevented from passing the cylinder 110.

As will be understood from the above, the partition wall 152 in the cylinder can exert a pressure on the coal pieces in the lower chute portion to maintain the movement of coal in all portions of the chute.

Preferably the edge 118 is chamfered to form a cutting edge which can break up and force its way through any pieces of coal which might otherwise become jammed between the edge 118 and the edge 132.

When the volume of the pocket in the cylinder is small, the cylinder rotates faster and the pushing effect occurs more sharply and frequently. The cylinder separates the coal in the inlet chute from the coal in the hopper.

All of the refractories may be made of 95% Silicon Carbide.

I claim:

1. A high intensity method of burning solid fuel in pieces, comprising the steps of:

advancing the fuel along a path having an upstream portion from which air is excluded;

metering the height of the fuel leaving the upstream path portion to define a predetermined cross section for the fuel as it leaves the upstream path portion and enters a first downstream path portion in a reverberatory combustion space as a thick fuel bed;

passing a first high velocity stream of air from below the first downstream path portion upwardly through the fuel bed in a self-sustaining ignition zone, the first stream of air supplying the major portion of the oxygen required for combustion and having upstream and downstream boundaries extending transversely of the path, the fuel being rapidly heated and ignited as it moves through the upstream boundary, the metered height of the fuel fed being such in relation to the speed of advance of the fuel and the distance between the upstream and downstream boundaries that the size of the fuel pieces and the thickness of the burning fuel bed at the downstream boundary is still sufficient to prevent destabilization of the fuel bed by the first stream; and passing a second, lower velocity stream of air, sufficient to complete combustion, through the fuel bed at a second downstream path portion which is downstream of the first downstream path portion, the second stream being diffused over a sufficient length of the path downstream of the first stream so as to be of sufficiently low velocity to avoid entrainment of the burning-out fuel particles from the fuel bed.

2. A method according to claim 1, wherein the second stream contains from 5% to 15% of the total air required for combustion of the fuel.

3. A method according to claim 1 or 2 wherein the second stream is formed by gases which are evolved by the fuel immediately upstream of the ignition zone and which are drawn off, together with some of the air from the first stream, from the fuel bed in the region between the upstream portion of the fuel path and the ignition zone.

4. A method according to claim 1, wherein the first stream of air after passing through the fuel bed is effectively prevented from flowing upstream from the upstream boundary to prevent the combustion from burning back into the upstream portion of the fuel path.

5. A method according to claim 1, including the steps of supplying a main stream of air into a chamber located below said first downstream path portion, then causing a majority of this main stream to flow upwardly through the fuel bed within this first downstream path portion for defining said first stream, passing a minority of the main stream from said first chamber directly into a second chamber located below the second downstream path portion, and then causing this minority of the main stream to flow upwardly through the fuel bed in said second downstream path portion for defining said second stream.

6. A furnace for burning solid fuel in pieces comprising means defining a reverberatory combustion chamber having a metering opening, a reciprocatory grate comprising longitudinally reciprocatory grate bars projecting into the combustion chamber for advancing solid fuel along the grate through the metering opening into the combustion chamber, means for supplying solid fuel to fill the entry to the metering opening, means for preventing air from entering the solid fuel upstream of the metering opening, a first set of air channels through the grate for passing a high-velocity first stream of air up through the fuel bed on the grate downstream of the metering opening, said first channels being sized to pass substantially the whole of the air required for combustion separation means associated with said grate for defining upstream and downstream boundaries for the first stream, and a second set of air channels through the grate for passing a restricted second stream of diffused air up through the portion of the fuel bed on the grate downstream of the first channels to complete the combustion of the fuel, said furnace including wall means whereby substantially no air from any of the said channels is able to enter the fuel upstream of the metering opening.

7. A furnace according to claim 6, wherein a distribution chamber is formed beneath the second air channels and beneath the grate and an air inlet for the second stream of air leads into the chamber in a position spaced downwardly from the grate.

8. A furnace according to claim 7, wherein the air inlet faces in a direction having a downward component for deflecting the air downwardly away from the grate as it enters the distribution chamber.

9. A furnace according to claim 7 or 8 wherein the air inlet is formed between upper and lower plates extending across the width of the chamber, the lower edge of the upper plate overlapping but being spaced downstream from the upper edge of the lower plate.

10. A furnace according to claim 9, wherein the spacing between the upper edge of the lower plate and the lower edge of the upper plate is adjustable.

11. A furnace according to claim 6, wherein wall means define an inclined hollow chute for feeding fuel to the metering opening, the wall means including a chute surface which is inclined to the grate at an obtuse angle leads down onto the grate at the entry to the metering opening, the chute surface forming the lowermost surface of the chute the front-to-back depth of which increases progressively towards the grate but is less than the height of the metering opening.

12. A furnace according to claim 11, wherein the chute surface is inclined to the horizontal at an acute angle greater than the angle of repose of the solid fuel.

13. A furnace according to claim 11 or 12, wherein the fuel supplying means includes a metering valve means for supplying fuel to the inclined chute while effectively sealing the chute from the outside air, said valve means comprising a drum having an aperture, the drum being driven in rotation within a casing which co-operates with the drum substantially to exclude outside air from the chute in all rotary positions of the drum.

14. A furnace according to claim 13, wherein the direction of rotation of the drum is such that the lowest portion of the drum at any instant moves in the same direction as the fuel on the grate, and wherein a pusher element is mounted in the drum at the trailing end of the aperture to assist in moving the solid fuel down the chute surface.

15. A furnace according to any of claim 13 wherein the trailing edge of the aperture in the drum has a cutting edge for cutting through obstructive pieces of solid fuel.

16. A furnace according to claim 6, wherein a duct extends between an inlet adjacent an upper surface of the metering opening and a chamber which is beneath and communicates with the second air channels.

17. A furnace according to claim 6, wherein the grate comprises parallel grate bars and the channels are formed by slots defined by adjacent bars and the width of the slots forming the first channels are at least twice the width of the slots forming the second channels.

18. A furnace according to claim 6 wherein the roof of the metering opening is formed of refractory material of low thermal conductivity.

19. A furnace according to claim 18 wherein the roof of the combustion chamber is of higher thermal conductivity than the roof of the metering opening.

20. A furnace according to claim 6, including means defining first and second air distribution chambers formed below and in communication with said first and second sets of air channels, respectively, means for supplying outside air into said first distribution chamber, and means defining a bypass opening for permitting a small fraction of the air supplied to said first distribution chamber to flow directly therefrom into said second distribution chamber so as to then flow upwardly through said second channels and define said second air stream.

21. A furnace according to claim 20, wherein the means defining said bypass opening includes deflector means which is positioned substantially directly below the grate in the region between the first and second channels for deflecting the air downwardly away from the grate as it flows into the second distribution chamber for more uniformly distributing the air along the length of the second channels.

22. A furnace according to claim 20, wherein the upstream ends of the first channels are positioned substantially directly below the metering opening so as to effectively define the upstream boundary of the first air stream and prevent the air from entering the solid fuel disposed upstream of the metering opening.

23. A furnace according to claim 20 or claim 21, wherein the first channels have a width which is substantially greater than the width of the second channels so that the first air stream contains therein at least approximately 85% of the total air required for combustion of the fuel.

* * * * *

UNITED STATES PATENT AND TRADEMARK OFFICE

CERTIFICATE OF CORRECTION

PATENT NO. : 4 348 968

DATED : September 14, 1982

INVENTOR(S) : Viking Valentin Demar

It is certified that error appears in the above—identified patent and that said Letters Patent is hereby corrected as shown below:

Col. 9, lines 55-56; change "combustion separation" to ---combustion, separation---.

Signed and Sealed this

*Fifteenth* Day of *February 1983*

[SEAL]

*Attest:*

GERALD J. MOSSINGHOFF

*Attesting Officer*

*Commissioner of Patents and Trademarks*